US005324562A

United States Patent [19]

Mullinax et al.

[11] Patent Number: 5,324,562

[45] Date of Patent: Jun. 28, 1994

[54] MULTIPLE SEGMENT CARPET TILE AND METHODS AND APPARATUS FOR PRODUCTION OF SUCH TILE

[76] Inventors: Larry E. Mullinax, 415 Ashford Cir.; Harold F. Adams, 3436 Roanoke Rd.; Wayne M. Hamilton, 20 Turkey Point Dr., all of LaGrange, Ga. 30240

[21] Appl. No.: 824,548

[22] Filed: Jan. 23, 1992

[51] Int. Cl.[5] ..... B32B 9/00

[52] U.S. Cl. ..... 428/95; 428/48; 428/88; 428/89

[58] Field of Search ..... 428/95, 88, 48, 89

[56] References Cited

U.S. PATENT DOCUMENTS

| | | | |
|---|---|---|---|
| 4,010,302 | 3/1977 | Anderson et al. | 428/95 |
| 4,081,579 | 3/1978 | Queen et al. | 428/95 |
| 4,522,857 | 7/1985 | Higgins | 428/95 |
| 4,576,665 | 3/1986 | Machell | 428/95 |
| 4,617,210 | 10/1986 | Zybko | 428/35 |
| 4,629,642 | 12/1986 | Kernstock | 428/95 |
| 4,680,209 | 7/1987 | Zybko et al. | 428/35 |
| 4,702,950 | 10/1987 | Slosberg et al. | 428/95 |
| 4,877,669 | 10/1989 | Endrenyi, Jr. et al. | 428/88 |
| 4,913,952 | 4/1990 | Fowler | 428/87 |
| 5,004,638 | 4/1991 | Goss | 428/95 |
| 5,030,497 | 7/1991 | Claessen | 428/95 |
| 5,116,439 | 5/1992 | Raus | 428/43 |

OTHER PUBLICATIONS

Heuga "L'Apport Incomparable D'Heuga".
Heuga/Mediasol.
Heuga "La Communication Par Le Sol".
Heuga, "Des Sols Couverts de References".
Heuga, photo of various company logos.
Mediasol, "Vos Sols Vont S'Afficher" (6 photos and translation).

*Primary Examiner*—Patrick J. Ryan
*Assistant Examiner*—Abraham Bahta
*Attorney, Agent, or Firm*—Kilpatrick & Cody

[57] ABSTRACT

Tile segments in desired shapes are out with great precision utilizing a computer-controlled laser and assembled on a previously prepared secondary backing with a sheet of hot melt adhesive material interposed between the assembly of segments and the secondary backing. The hot melt adhesive is then heated to fuse the assembly together while its components are securely held in their desired positions.

3 Claims, 5 Drawing Sheets

MULTIPLE SEGMENT CARPET TILE AND METHODS AND APPARATUS FOR PRODUCTION OF SUCH TILE

BACKGROUND OF THE INVENTION

The history of carpet and carpet tile has involved ongoing efforts to produce such floor-covering products that have increasingly sophisticated and attractive designs and to develop techniques for executing increasingly sophisticated designs in such products utilizing high volume production techniques. Efforts directed toward these objectives have involved utilization of different types of yarns, different yarn pile structures (e.g., loop pile or cut pile), and different carpet structures (e.g., tufted, fusion bonded and woven). Various techniques for varying the pile appearance have been developed, and enormous effort has been devoted to techniques for dyeing, printing, and over-printing carpet products in order to impart visually pleasing patterns. There are, however, limits associated with the design variations possible with each of these techniques that are inherent in the limitations of the structure or technique being utilized. For instance, a fusion bonded carpet product must inherently utilize a fusion bonded structure and cannot, therefore, offer design possibilities that may be available through use of a tufted carpet structure.

SUMMARY OF THE INVENTION

The present invention provides a carpet tile structure and practical methods and apparatus for producing that structure that dramatically expand the choices available to a designer by providing a carpet tile that is assembled from segments of face yarn and primary backing material previously produced separately. By utilization of such segments of "half cloth" it is possible to combine in a single tile dramatically different materials and thereby achieve visually dramatic contrast between materials in the tile. It is possible, for instance, to combine fusion bonded and tufted tile segments, to utilize tile segments with differing types and compositions of yarns, to utilize tile segments with different types and heights of yarn pile, and to utilize tile segments of dramatically different color and texture.

Tile segments of the desired shapes are cut with great precision utilizing a computer-controlled laser. The segments are then assembled in their final configuration on a previously prepared secondary backing with a sheet of hot melt adhesive material interposed between the assembly of segments and the secondary backing. The hot melt adhesive is then heated to fuse the assembly together while its components are securely held in their desired positions.

After cooling, the resulting carpet tile may then be installed in any of the conventional manners. Because of the precise alignment of tile components achieved utilizing the techniques and apparatus of the present invention, it is possible to produce such tiles having a pattern that is continuous from one tile to an adjacent tile, and it is also possible for the pattern "repeat" to span any desired number of tiles or, if desired, utilizing appropriate computer control, the pattern need not repeat within any finite arrangement of tiles.

DETAILED DESCRIPTION OF THE DRAWINGS

Figure 1:
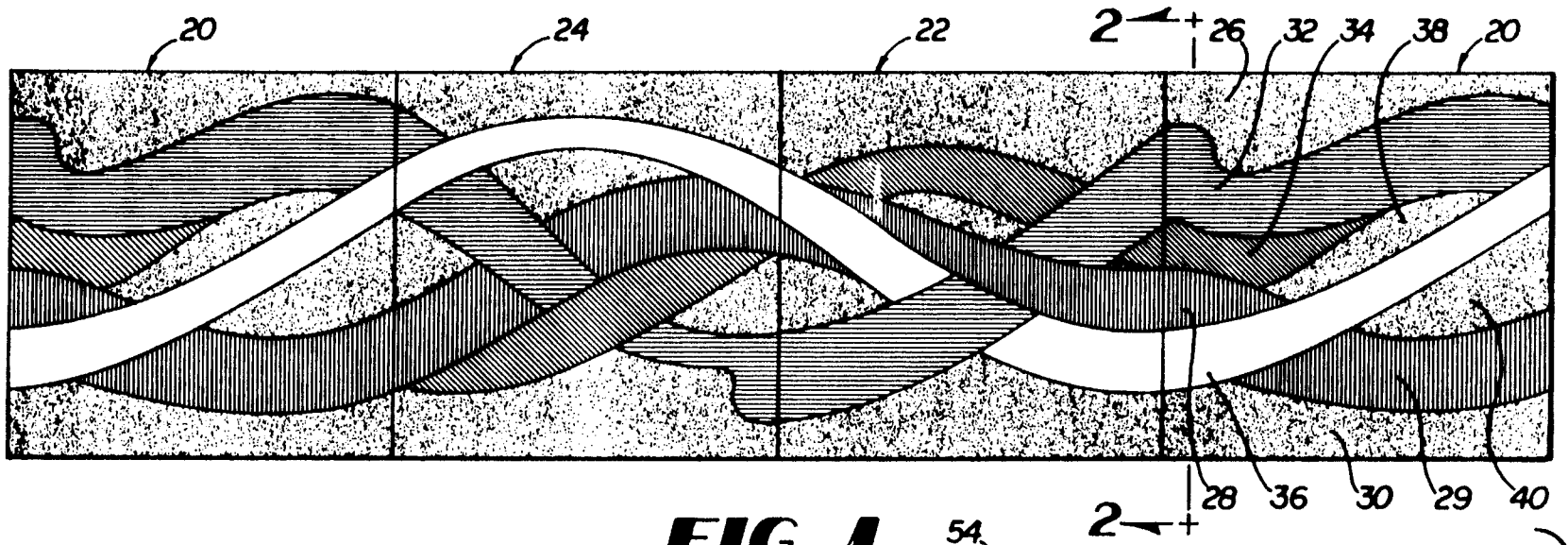
FIG. 1 is a top plan view of four carpet tiles of the present invention having a pattern that is repeated every three tiles.

FIG. 1 illustrates three different carpet tiles 20, 22, and 24 produced in accordance with the present invention with a pattern that repeats every third tile. The structure of an exemplary tile 20 may be understood by reference to FIGS. 1 and 2. Tile 20 is assembled from nine segments of carpet tile "half cloth," a term which refers to the upper portion of a carpet tile structure comprising face yarn and primary backing. Half cloth may, if desired, include reinforcing scrim. Each such segment may be a different structure, type of yarn, and color, and segments may be printed or over-printed. For instance, as may be seen in the cross-sectional view of tile 20 shown in FIG. 2, segments 26, 28, and 30 are shown as loop pile structures, and segments 32, 34 and 36 are illustrated as cut pile structures. All of the segments 26, 28, 29, 30, 32, 34, 36, 38, and 40 that comprise tile 20 fit together like a jigsaw puzzle to provide a square carpet tile structure without any gaps or voids.

Figure 2:
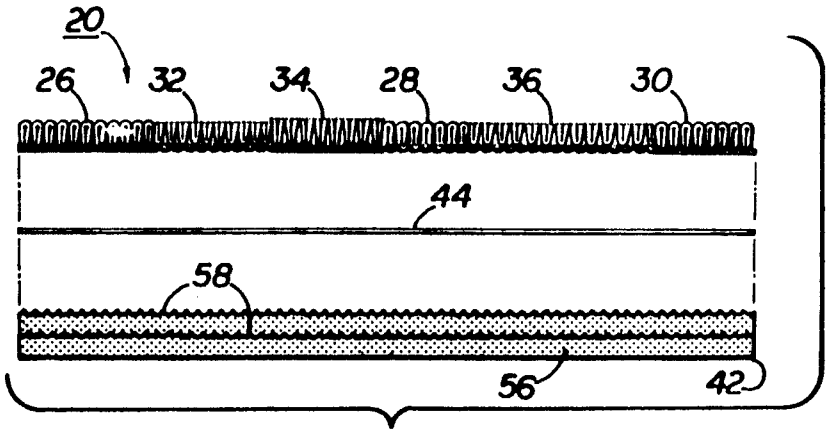
FIG. 2 is an exploded cross-sectional view taken along line 2—2 in FIG. 1.

The segments 26–40 are assembled as illustrated in FIG. 2 on a primary backing segment 42 having the shape and dimensions (typically square) of the finished tile. Interposed between the underside of the segments 26–40 and the primary backing 42 is a sheet of hot melt adhesive material 44.

Hot melt adhesive 44 may be ethyl vinyl acetate (EVA) adhesive sheets 0.025 inches thick and is also the same size as the finished tile 20. Such adhesive is available in preformed sheets or may be obtained in pellet form, melted and then cast on a conveyor belt to a desired thickness using a metering blade, as will be well-understood by one skilled in the art of carpet tile manufacture. Other adhesives having the desired bonding properties and relatively fast curing properties may also be used, such as adhesive that cures when subjected to radio-frequency (RF) radiation, among others.

Figure 3:
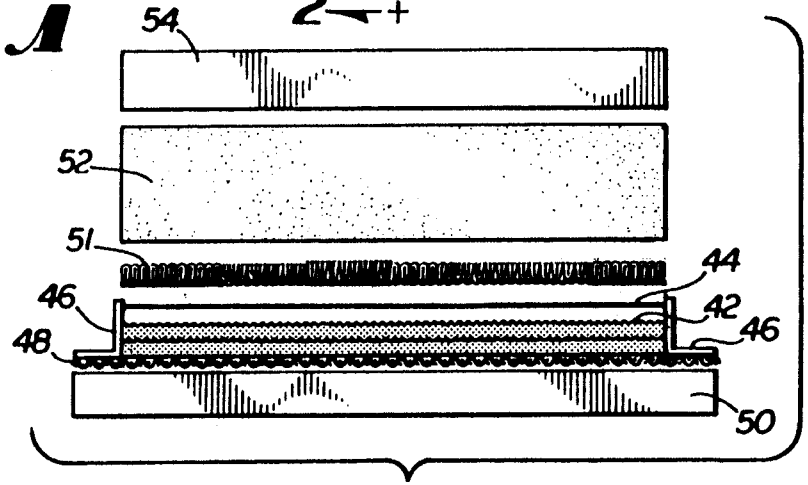
FIG. 3 is an exploded cross-sectional view similar to FIG. 2 showing the carpet tile components of FIG. 2 together with apparatus used to assemble those components.

Assembly of tile 20 may be understood by reference to FIG. 3 where the secondary backing 42 and hot melt adhesive 44 are shown positioned within a frame 46 that may, for instance, be made of angle iron with interior dimensions equal to the finished dimensions of the tile 20. Backing 42 and frame 46 may rest, for instance, on a teflon-coated fiberglass belt 48, which belt in turn rests on a heated platen 50. After the tile segments 26–40 are assembled within frame 46 and on top of hot melt adhesive 44, a section or block of resilient foam 52 approximately three inches, for instance, thick and of the same length and width as the finished tile 20 is positioned on top of and lying against the face yarn 51 of the segments. Usable foam 52 may be polyurethane foam of the type commonly used for padding in upholstered furniture. A weight 54, preferably also of the same size as tile 20, is placed on top of the foam 52 in order to provide sufficient pressure for the foam to conform to the contour of the different face yarn 51 pile heights of the segments 26–40, and thereby exert substantially equal pressure against each segment 26–40, regardless of height.

Heat is then applied to the assembly by means of heated platen 50 in order to melt hot melt adhesive sheet 44 and bond segments 26–40 to secondary backing 42. The assembly is then cooled and removed from frame 46 as the finished carpet tile 20 comprising segments 26–40 adhesively bonded to secondary backing 42. Secondary backing 42 may comprise a plastic matrix 56 of polyvinyl chloride, atactic polypropylene, polyurethane, ethyl vinyl acetate or other materials and typically will include one or more stiffening and stabilizing layers 58 of fiberglass or other suitable material.

Figure 8:
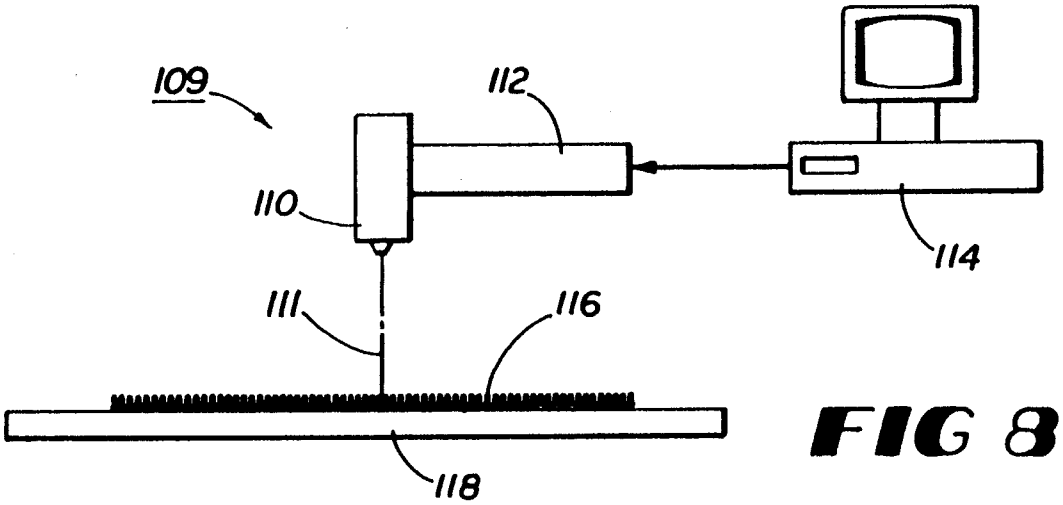
FIG. 8 is a schematic side elevation view of a laser apparatus for cutting tile segments in accordance with the present invention.

While segments 26–40 can be die-cut or cut utilizing other techniques, such as high-pressure water cutting, they can successfully be cut with the necessary accuracy and desirable design flexibility utilizing a computer-controlled laser such as a conventional "numerically controlled" or computer controlled $CO_2$ laser. Such a laser 110 and associated components are illustrated in FIG. 8 and further described below.

Figure 4:
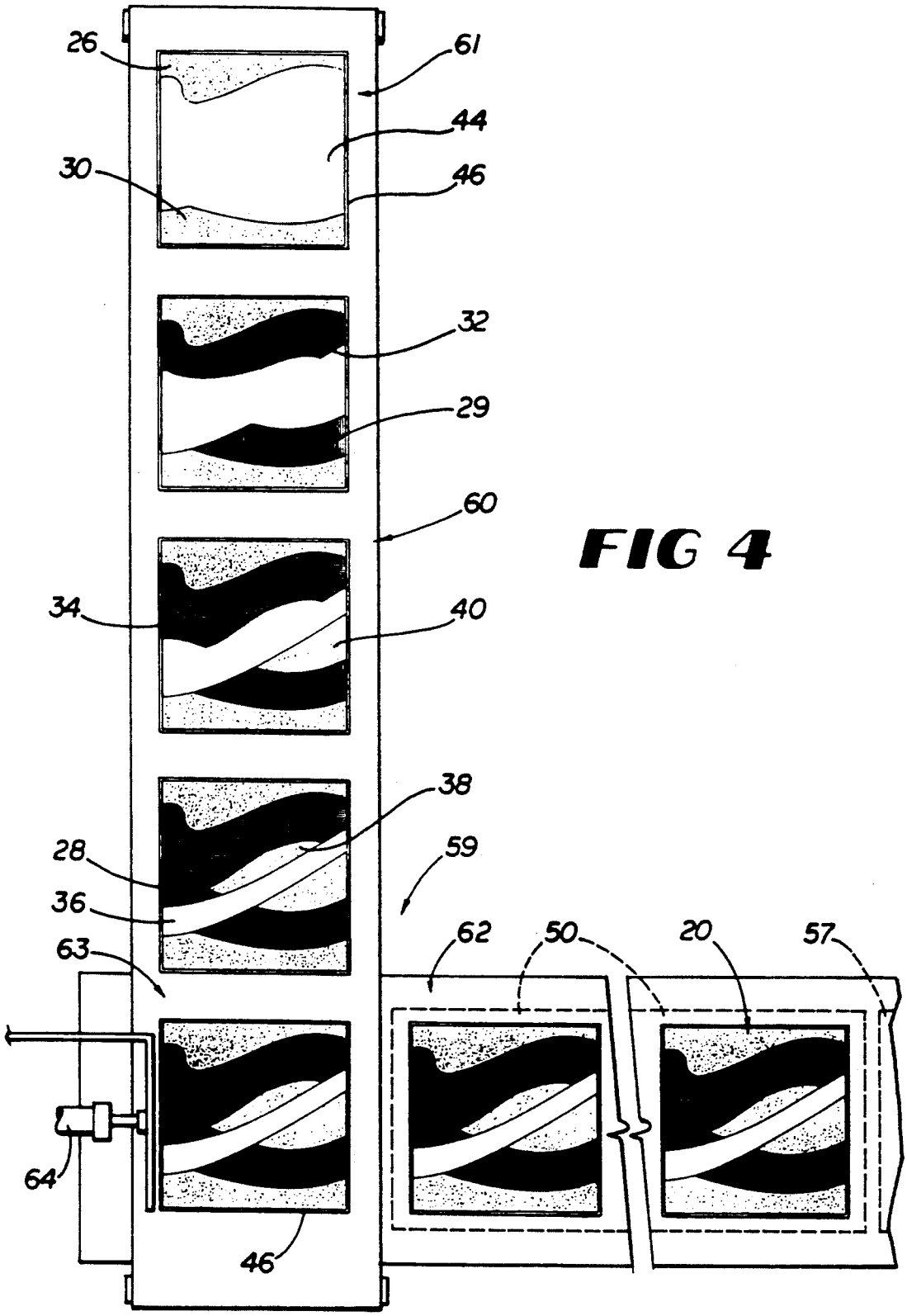
FIG. 4 is a schematic top plan view of an apparatus for assembling the carpet tile of the present invention.

FIG. 4 is a top plan view, partially schematicized, of an apparatus 59 usable to assemble the carpet tiles 20 of the present invention from previously cut segments 26–40. The assembly apparatus 59 comprises generally an assembly belt 60, along which materials advance toward the bottom of FIG. 4, and a heated belt 62 that advances toward the right side of FIG. 4. Each of belt 60 and 62 may be teflon-coated fiberglass belts of the type conventionally used in carpet tile manufacturing.

Tiles 20 are assembled o belt 60 by first positioning the bottomless frame 46 on the belt at the end 61 (at the top of FIG. 4) with secondary backing 42 within the frame and lying against belt 60 and hot melt adhesive 44 positioned on top of secondary backing 42. Segments 26–40 of tile 20 are then assembled within the frame 46, which may be advanced along belt 60 toward end 63 at the bottom of FIG. 4 during assembly (by sliding on the belt or advancing the belt), thereby permitting a portion of the assembly of segments to be accomplished at each of several assembly positions by a worker located adjacent to each such position, four of which positions are illustrated in FIG. 4. When the completely filled frame 46 arrives at the end 63 of assembly belt 60 (as shown at the bottom of FIG. 4), it can be pushed or slid off onto heated belt 62 manually or with an appropriate hydraulic ram 64 or other apparatus.

After all segments have been positioned within frame 46, a foam block 52 and weight 54 (not shown in FIG. 4) are positioned on top of the assembly as illustrated in FIG. 3. A platen 50 heated with oil, or other suitable means for heating the tile 20 assembly and hot melt adhesive 44, is positioned to heat the tile 20 assembly, such as under belt 62. After the application of adequate heat to sufficiently melt adhesive 44, belt 62 may pass over a cooling means 57 that permits the temperature of adhesive 44 to drop sufficiently to bond segments 26–40 to secondary backing 42.

Figure 5:
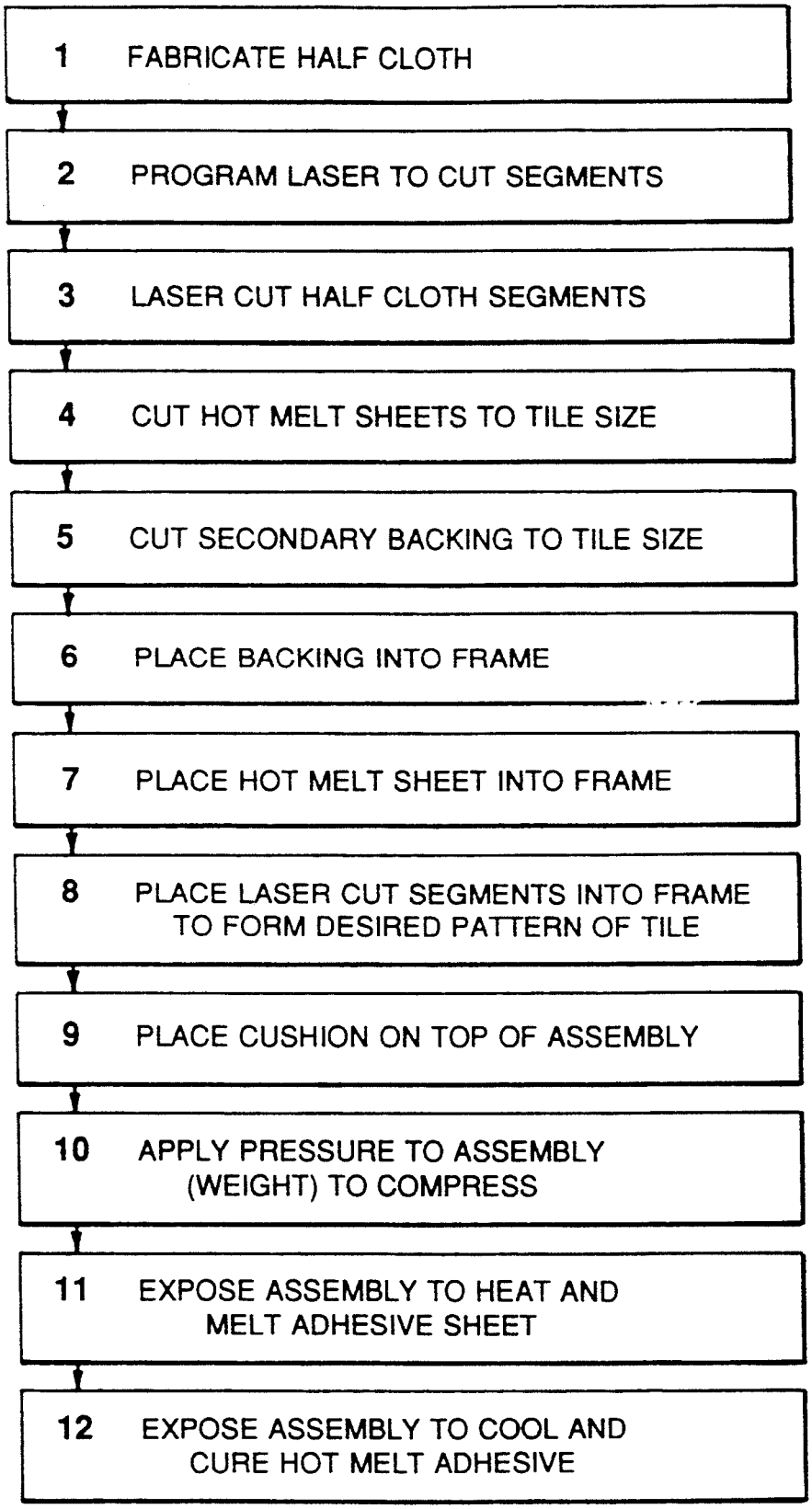
FIG. 5 is a flow diagram showing steps in one method of manufacturing carpet tile in accordance with the present invention.

FIG. 5 illustrates in flow-chart form the principal steps in a typical method of fabrication of a carpet tile 20 of the present invention.

Figure 6:
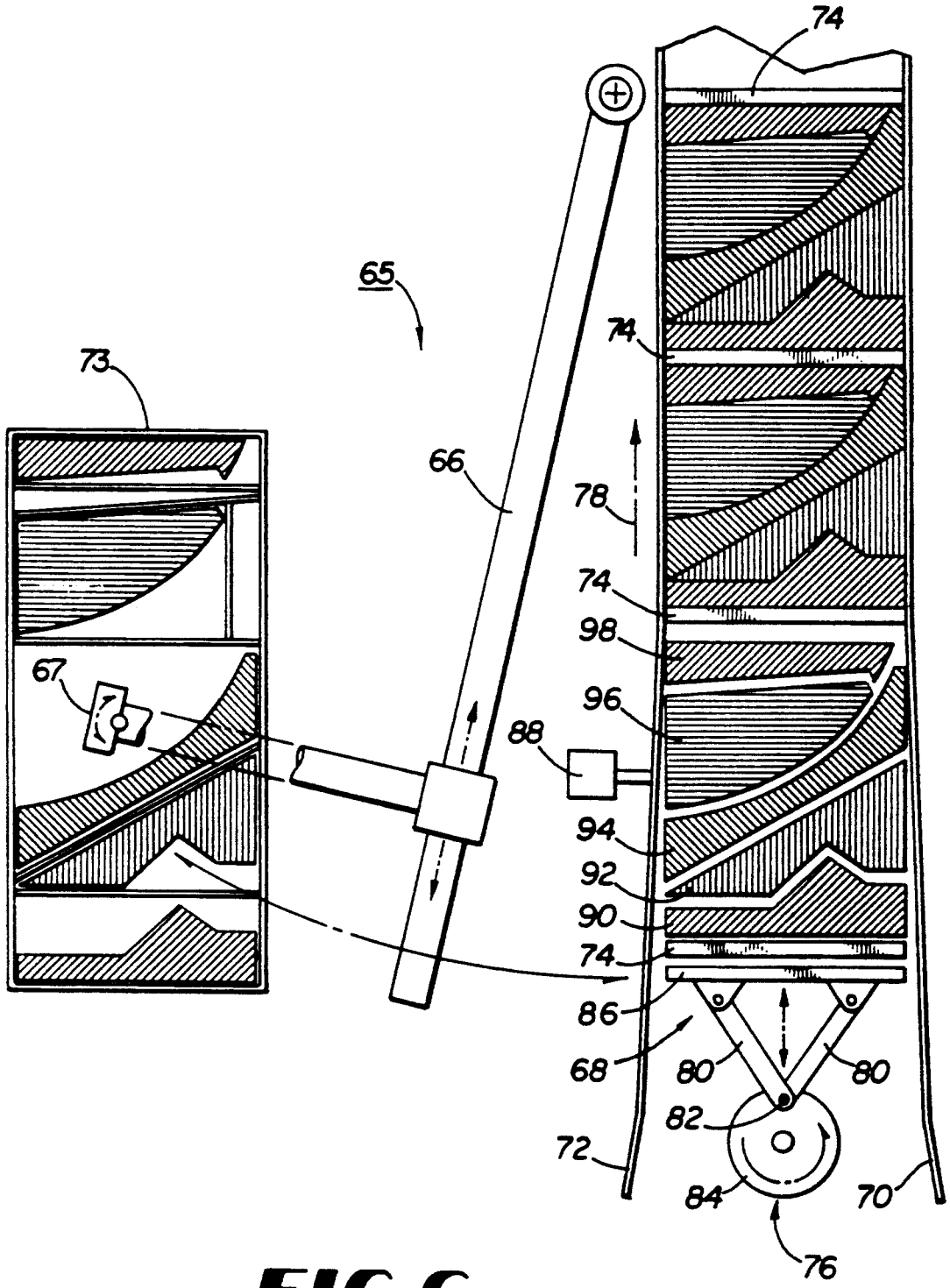
FIG. 6 is a schematic top plan view of an alternative apparatus for assembling the carpet tile of the present invention.

FIG. 6 illustrates an alternative apparatus 65 for assembly of carpet tile 20 of the present invention utilizing a robot arm 66 that grasps segments of carpet tile 20 from storage bins 73 with a pick-up foot 67 and places such segments in their desired relative positions on an assembly table 68 between a pair of generally parallel fences 70 and 72. Fences 70 and 72 are separated a distance greater than the finished width of the carpet tile 20 where the tile segments are assembled, and fences 70 and 72 approach each other until they become parallel at a distance equal to the finished width of tile 20. Tile assemblies 20 are separated by spacer bars 74 that advance with the assemblies, and a pusher 76 for advancing the assemblies exerts pressure to cause the assemblies to advance in the direction of arrow 78 (toward the top of FIG. 6) between the fences 70 and 72. Pusher 76 may comprise two links 80 attached between a push bar 86 and a common point 82 on a rotating disk 84, which will cause push bar 86 to "wobble" as it advances and retreats. Such wobbling motion can facilitate assembly of segments 92, 94, 96 and 98 as desired. It may also be desirable to utilize a vibration means 88 attached to one or both fences 70 and 72 to encourage the segments to come together without gaps as desired as they progress in the direction of arrow 78. Pusher 76 may be constructed in a wide variety of alternative configurations. For instance, links 80 could be driven by separate disks that rotate in synchronism so that push bar 86 does no wobble as it advances.

Robot arm 66 may be a General Machine Design, Inc., Palisades Park, N.J. 07650, Model No. GAP-100-84H with a foot 67 of the vacuum or retracting pins type, among other alternatives.

Figure 7:
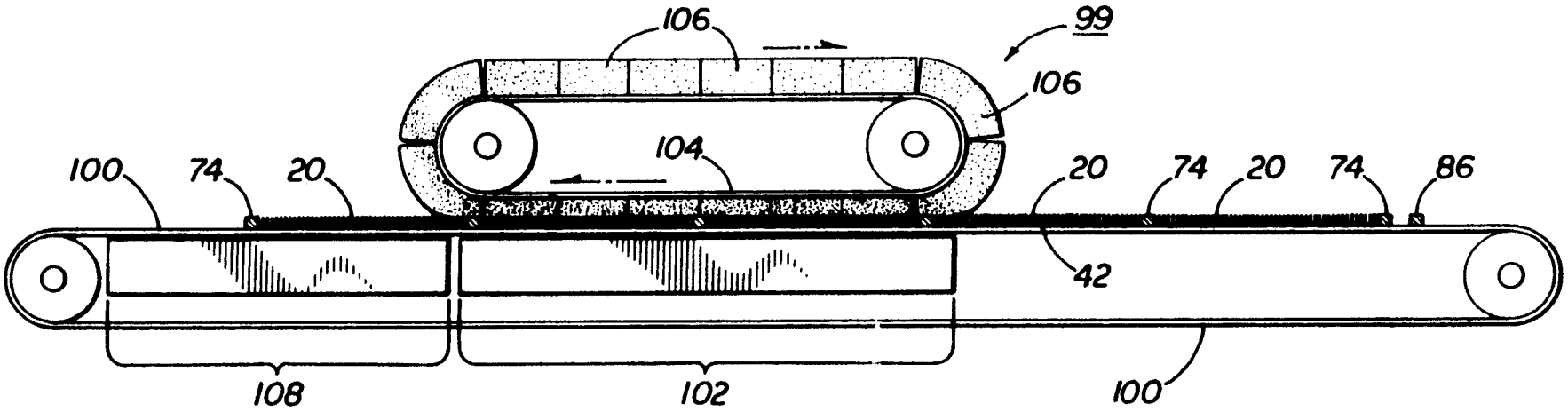
FIG. 7 is a schematic side elevation view of an alternative embodiment of a conveyor line for curing the adhesive during production of the carpet tile of the present invention.

FIG. 7 illustrates a schematic side elevation of the adhesive curing portion 99 of an automated assembly line in accordance with the present invention. Assemblies of components of tile 20 resting on a conveyor belt 100 advance from right to left of FIG. 7 over a zone 102 where heat is applied to the underside of belt 100 utilizing a heated platen as described above or other appropriate means. A pressure applying belt 104 carrying foam 106 (that may be segmented as illustrated in the drawing or unitary) is positioned above conveyor belt 100 and advances in synchronism with conveyor belt 100 so that pressure is applied to advancing assemblies of carpet tile 20 for the purpose of bonding tile segments to secondary backing 42 in their appropriate positions and relationship as described above. Tiles 20 then progress from the heat zone 102 to a cooling zone 108 where heat is extracted from the assembly 20 by any appropriate conventional means in order to allow the hot melt adhesive 44 (not visible in FIG. 7) to cool.

FIG. 8 schematically illustrates apparatus 109 for cutting tile segments 26–40 or 90≧98 utilizing an appropriate laser 110 that is moved, or the beam 111 from which is moved, by laser control mechanism 112. Mechanism 112 may be an appropriate x-y axis device or any other suitable device for causing the laser beam 111 and half cloth 116 being cut to move relative to each other as desired. Laser control mechanism 112 is controlled by computer 114 that is appropriately programmed to cut half cloth 116 into segments in the desired shape or shapes. Half cloth 116 rests on a support 118 that may be an appropriate stationary table, may be a part of laser control mechanism 112 (in embodiments in which the half cloth 116 is moved during cutting) or may be part of a conveyor system that advances half cloth 116 to be cut into the cutting field and removes cut segments and waste after cutting.

As will be readily understood by one skilled in the art, the apparatus illustrated in FIG. 8 can be located adjacent to bins 73 illustrated in FIG. 6, and a robot arm similar to arm 66 or other automated means can be utilized for transferring segments from the cutting apparatus 109 to bins 73. Alternatively, it is possible to bypass bins 73 and transfer cut segments directly from cutting apparatus 109 utilizing, for instance, a robot arm, to their assembly point in the assembly apparatus 65 illustrated in FIG. 6. One such configuration of automated assembly elements might utilize more than one cutting apparatus 109 operating substantially simultaneously to feed different half cloth segments to the assembly apparatus 59.

The foregoing description of this invention is for purposes of explanation and illustration. It will be apparent to those skilled in the art that modification and changes may be made to this invention as thus described without departing from its scope and spirit.

We claim:

1. A carpet tile comprising a plurality of visibly different segments of carpet tile half cloth bonded to a secondary tile backing with a layer of hot melt adhesive.

2. The carpet tile of claim 1 wherein at least one of the half cloth segments comprises cut pile face yarn and at least one other of the half cloth segments comprises loop pile face yarn.

3. The carpet tile of claim 1 wherein the secondary backing comprises a plastic matrix and at least two fiberglass layers.

* * * * *